US005412837A

United States Patent [19]

Wörwag

[11] Patent Number: 5,412,837

[45] Date of Patent: May 9, 1995

[54] VACUUM CLEANER

[75] Inventor: Peter Wörwag, Romanshorn, Switzerland

[73] Assignee: Firma Fedag, Romanshorn, Switzerland

[21] Appl. No.: 23,847

[22] Filed: Feb. 26, 1993

[30] Foreign Application Priority Data

Feb. 28, 1992 [DE] Germany ..... 42 06 187.3

[51] Int. Cl.[6] ..... A47L 5/36

[52] U.S. Cl. ..... 15/353; 15/327.6; 15/326; 15/352

[58] Field of Search ..... 15/327.6, 352, 353, 15/327.1

[56] References Cited

U.S. PATENT DOCUMENTS 1,774,062 8/1930 Juelson .
2,649,927 8/1953 Ortega ..... 15/327.1 X
2,889,006 6/1959 Ortega et al. ..... 15/327.6 X
3,334,371 8/1967 Seely et al. ..... 15/327.1

FOREIGN PATENT DOCUMENTS 1220944 5/1960 France ..... 15/327.6
2439578 5/1980 France .
2351769 10/1973 Germany .

*Primary Examiner*—Christopher K. Moore
*Attorney, Agent, or Firm*—Robert W. Becker & Associates

[57] ABSTRACT

A vacuum cleaner includes a receptacle and a cover, for closing the receptacle, having a radially open chute. A drive motor is connected within the cover. A suction fan, producing a suction air stream that is guided via the suction socket into the receptacle and removed from the receptacle, is attached within the cover. An angular suction socket is positioned within the chute. The angular suction socket has a first leg for receiving a suction hose that extends radially with respect to a longitudinal central axis of the vacuum cleaner and a second leg that extends substantially vertically into the receptacle at a distance from the longitudinal central axis. The second leg is connected within the chute in the vicinity of the longitudinal central axis so as to be vertically and horizontally tiltable. Preferably, the vacuum cleaner comprises a ball-and-socket joint for tiltably connecting the second leg of the suction socket within the chute.

17 Claims, 14 Drawing Sheets

VACUUM CLEANER

BACKGROUND OF THE INVENTION

The present invention relates to a vacuum cleaner comprising receptacle closed by a cover that contains a drive motor and a suction fan and in which the suction air flow is guided via an angular suction socket arranged at the cover into the receptacle, wherein the suction socket has a first leg for receiving a suction hose that extends radially relative to the longitudinal central axis of the vacuum cleaner and a second leg that extends vertically spaced at a distance from the longitudinal central axis.

A vacuum cleaner of this type known from DE-OS 23 51 769 can be used both as a "dry" cleaner for sucking up dry dirt as well as a "wet" cleaner for sucking up liquids. It consists of a receptacle with an attached cover. On account of the drive motor and suction fan located in the cover, a relatively high center of gravity results, for which reason the vacuum cleaner easily tends to tip over. A drawback of the prior art device is further that on account of the suction connection provided rigidly on the cover, every working movement of the suction hose is transmitted to the vacuum cleaner and the vacuum cleaner is thus moved essentially permanently. Thus, due to the unfavorable center of gravity, there is a permanent danger of tipping over the vacuum cleaner, due to which the cleaner itself or surrounding parts can be damaged. It should also be taken into consideration that the drive motor operating at approximately 20,000 r.p.m. and above is exposed to a mechanical/dynamic load, the so called Giro effect, at the time of each movement. Each movement of the vacuum cleaner thus loads the bearings and the carbon brushes. This can lead to premature wear of the bearings and breakdown of the vacuum cleaner.

U.S. Pat. No. 1,774,062 discloses a vacuum cleaner with a receptacle, which is closed by a cover containing the drive motor and the fan. The L-shaped suction connection is arranged on the cover. Its vertical section is coaxial with respect to the main axis of the receiving drum and is able to rotate about the main axis. The suction connection thus forms the highest point of the vacuum cleaner, due to which there is a high danger of tipping over when the suction hose is connected.

It is therefore an object of the present invention to develop a vacuum cleaner of the aforementioned kind with which the danger of tipping over is reduced and the loads on the motor are reduced.

BRIEF DESCRIPTION OF THE DRAWINGS

The object, and other objects and advantages of the present invention, will become more apparent from the following specification in conjunction with the accompanying drawings, in which.

SUMMARY OF THE INVENTION

Figure 1:
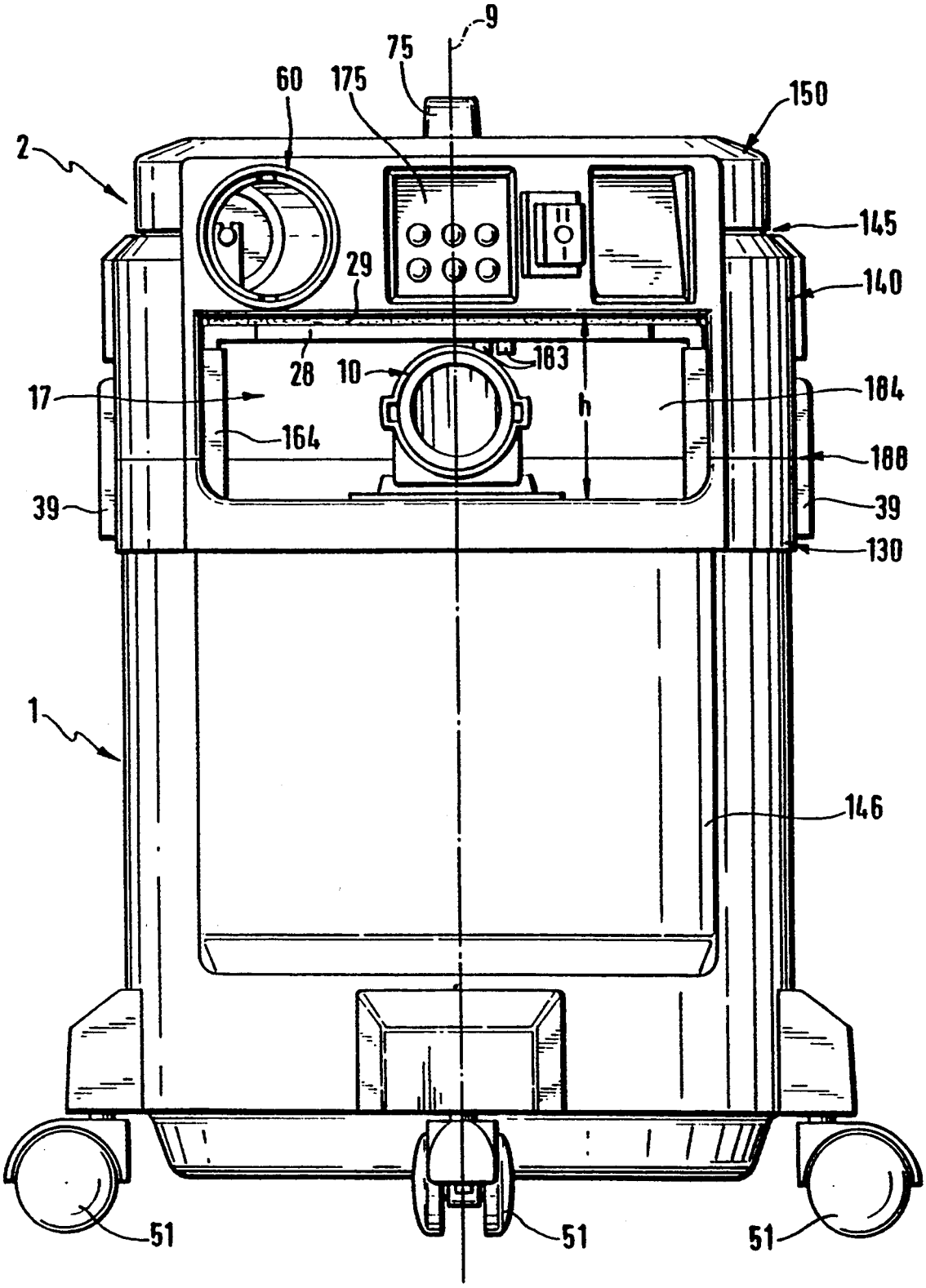
FIG. 1 is a front view of the inventive vacuum cleaner.

The vacuum cleaner of the present invention is primarily characterized by:

a receptacle;

a cover, for closing the receptacle, having a radially open passage;

a drive motor connected within the cover;

a suction fan, producing a suction air stream that is guided via the suction socket into the receptacle and removed from the receptacle, connected within the cover; and an angular suction socket positioned within the passage, the angular suction socket having a first leg for receiving a suction hose, the first leg radially extending with respect to a longitudinal central axis of the vacuum cleaner, and a second leg extending substantially vertically into the receptacle at a distance from the longitudinal central axis, the second leg connected within the passage in the vicinity of the longitudinal central axis so as to be vertically and horizontally tiltable.

Preferably, the vacuum cleaner further comprises a ball-and-socket joint for tiltably connecting the second leg of the suction socket within the passage.

Advantageously, the cover is comprised of a base casing, an intermediate plate, a bottom plate facing the receptacle, and a closure plate. The motor is positioned within the base casing and the suction fan is supported on the intermediate plate. The passage is delimited by the base casing and the intermediate plate. Expediently, the intermediate plate forms a bottom of the passage, and the ball-and-socket joint comprises a partial half-shell for tiltably supporting the second leg of the suction socket. In a further embodiment, an inlet channel is connected to the partial half-shell and extends into the receptacle. Preferably, the partial half-shell and the inlet channel form a unitary part.

The passage has a top portion opposite to its bottom. The top portion has an air outlet for the suction air stream. Preferably, the air outlet comprises an outlet filter. The top portion may also have an air outlet for a cooling air stream that also comprises an outlet filter.

In a preferred embodiment of the present invention, the passage extends over a segment angle of substantially 90° over a circumference of the cover. The second leg of the suction socket has a longitudinal axis that intersects an angle bisector of the segment angle. Preferably, the passage has a substantially parallelepipedal shape.

Expediently, the diameter of the first leg is smaller than a height h of the passage.

The motor and the suction fan each have a vertical axis spaced at a distance to the longitudinal central axis of the vacuum cleaner. Relative to the longitudinal central axis of the vacuum cleaner a center of gravity of the motor and a center of gravity of the suction fan are positioned diametrically opposite to the suction socket.

In the upright operating position of the vacuum cleaner, the first leg of the suction socket is spaced at a distance of substantially 80 cm above a floor surface on which the vacuum cleaner stands. The receptacle is supported substantially vertically below the suction socket on the floor surface.

Since the suction socket is mounted close to the longitudinal central axis of the vacuum cleaner, pulling forces which occur are introduced into the vacuum cleaner close to the longitudinal central axis, due to which the stability is increased. Due to the location of the suction socket in a radially open compartment of the cover, the radial section of the socket connection lies closer to the floor, for which reason the force ratios which occur with a suction hose hanging down do not lead to tipping over of the vacuum cleaner.

The vertically as well as horizontally tiltable mounting of the suction socket ensures that the suction cleaning tool connected with the suction hose can be moved in a certain working range, without the vacuum cleaner itself being moved. During vacuuming of a certain working region, the travelling vacuum cleaner remains virtually stationary, for which reason tipping over cannot occur. Furthermore, due to the reduced movement of the vacuum cleaner, careful treatment of the motor shaft bearings is achieved, since the forces occurring on account of the Giro effect occur solely at the time of a change of location of the vacuum cleaner.

In a development of the invention, the vertical axis of the drive motor and of the fan is located at a distance from the longitudinal central axis of the vacuum cleaner, the center of gravity of the drive motor and of the suction fan preferably lying diametrically opposite the suction connection. The weight of the drive motor and of the suction fan thus counteract tilting moments produced by pulling forces on the suction hose.

In daily practice it has proved advantageous to position the radial leg of the suction socket approximately 80 centimeters above the floor surface, on which the vacuum cleaner stands.

DESCRIPTION OF PREFERRED EMBODIMENTS

The present invention will now be described in detail with the aid of several specific embodiments utilizing FIGS. 1 through 17.

Figure 2:
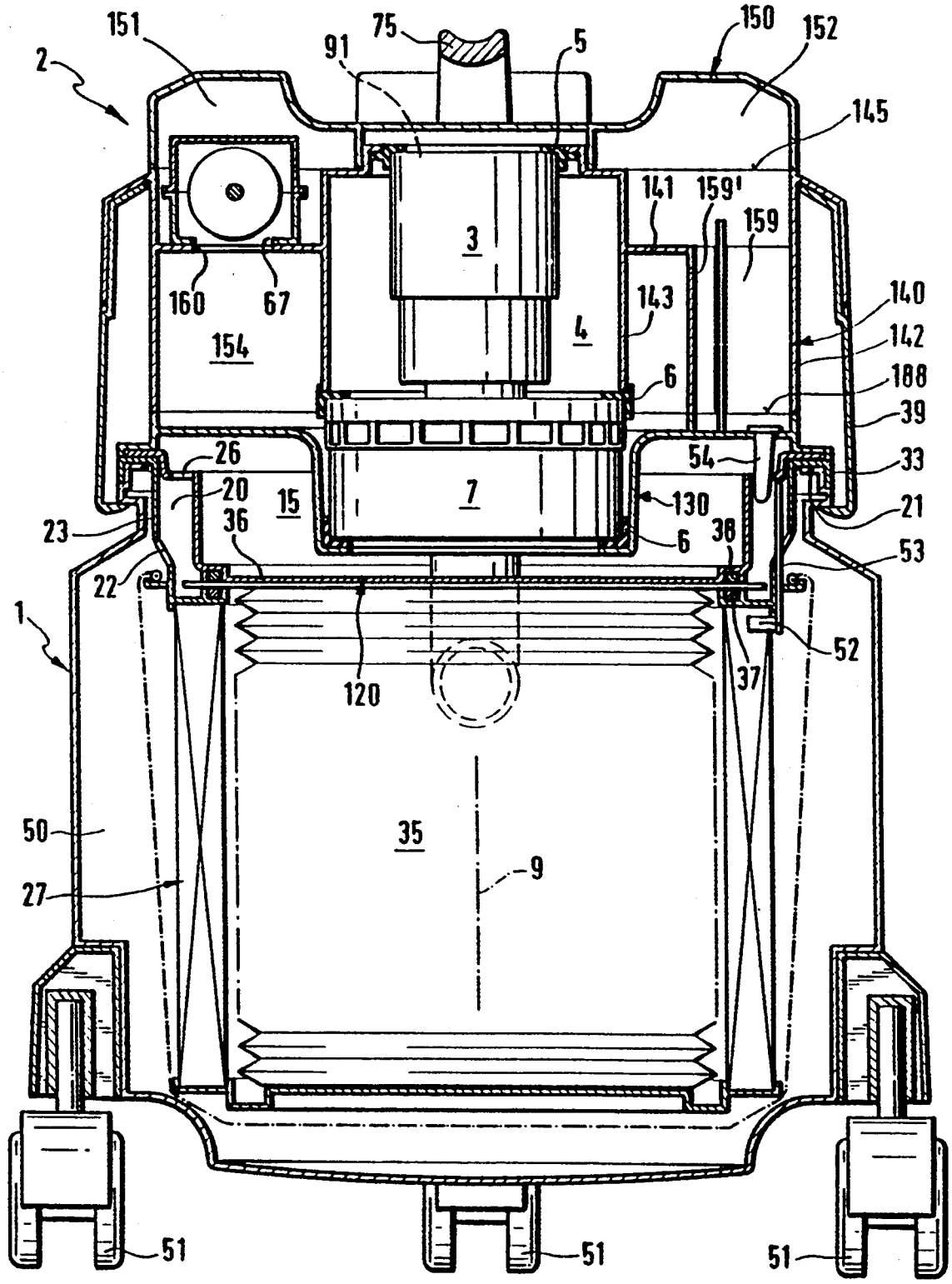
FIG. 2 is a longitudinal section through the vacuum cleaner of FIG. 1, extending transversely with respect to the handle.
Figure 4:
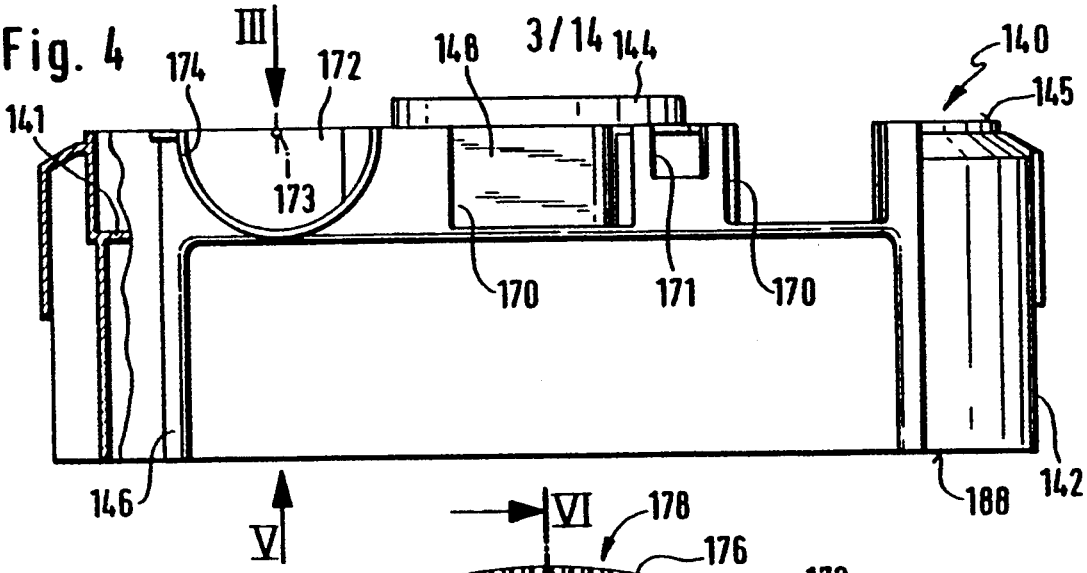
FIG. 4 is a view of the base casing in the direction of arrow VI in FIG. 3.

The vacuum cleaner illustrated in FIG. 1 in elevation and in FIG. 2 in section transversely to an upper handle 75, consists in its basic construction of a cylindrical container as the receptacle 1, which is closed by an attached cover 2. The receptacle 1 serves, when used as a "dry" vacuum cleaner, for receiving the dirt sucked up and, when used as a "wet" vacuum cleaner as a receiving container for the dirty liquid sucked up.

Provided in the cover 2 are the drive unit for the vacuum cleaner, all electrical control devices, all electrical connections, and all connections for the vacuum air stream. As can be seen in particular from the sectional view of FIG. 2, the cover 2 is composed of four parts, namely a bottom plate 120, an intermediate plate 130, a base casing 140 as well as an upper, cover-like closure plate 150 to which the handle 75 is attached.

The base casing 140, illustrated in FIG. 2 in section transverse with respect to the handle 75, is illustrated in detail in FIGS. 3 to 6. It consists of a circular base plate 141. Its center lies on the vertical longitudinal axis 9 (FIGS. 1, 2) of the vacuum cleaner. An outer wall 142 projects beyond the base plate 141 in both axial directions, so that the base casing 140, seen both from the closing cover 150 as well as from the intermediate plate 130, forms receiving chambers (FIG. 2). Passing through the base plate 141 is a receiving cylinder 143 which is open at both ends, the receiving cylinder 143 constructed with a stepped, reduced diameter at its end 144 facing the closure plate 150. The end 144 with the reduced diameter projects beyond the plane of separation 145 between the base casing 140 and the closure plate 150.

Figure 3:
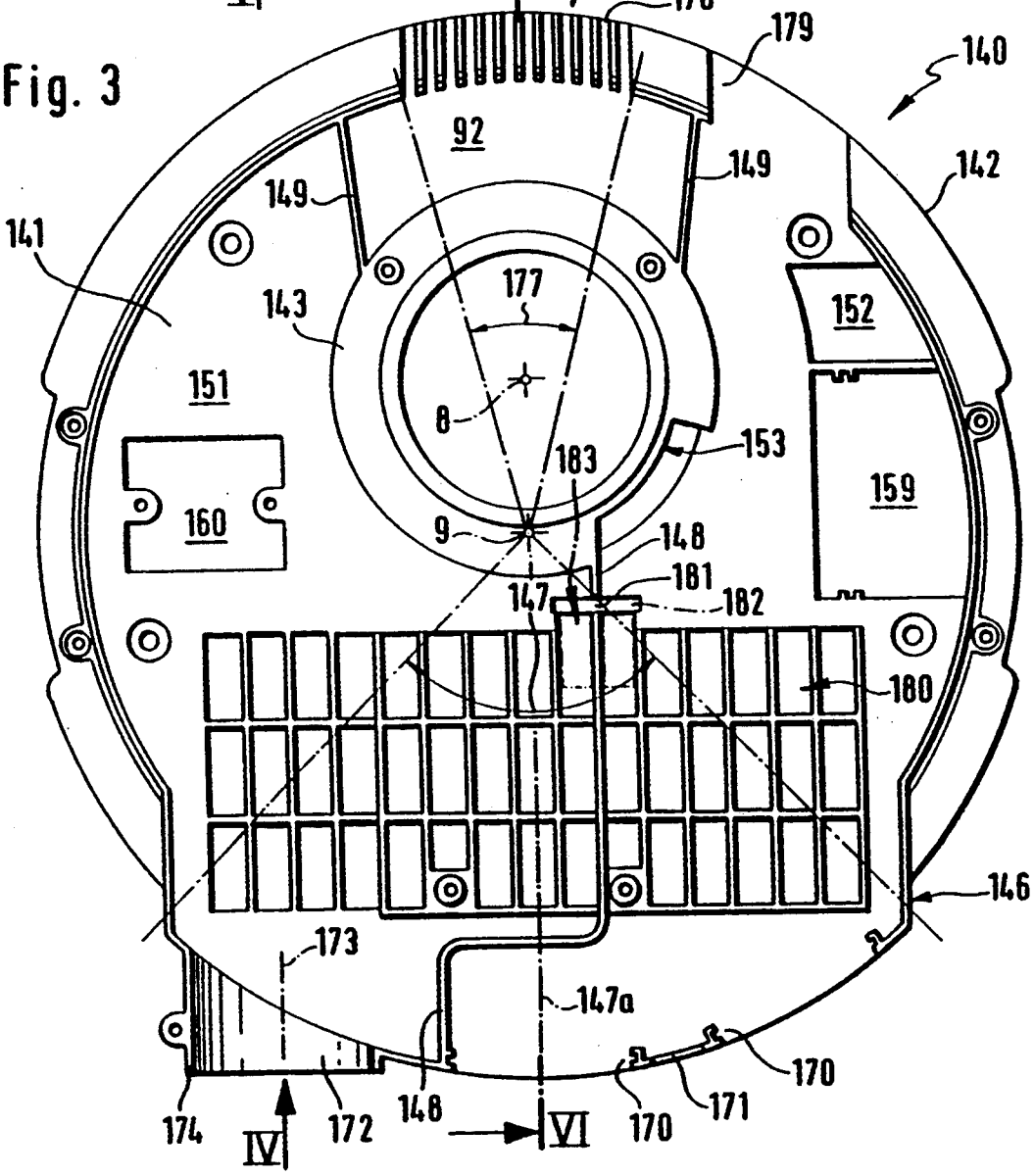
FIG. 3 is a plan view of the base casing of the cover, viewed from the closure plate.

As can be seen from the plan view according to FIG. 3, the base casing 140 has an enlarged radius over a segment angle 147 of approximately 100°, so that the base casing 140 forms a radial projection 146 over this angle 147. This radial projection 146 extends in the vertical direction substantially over the entire height of the vacuum cleaner and is consequently also provided at the receptacle, and serves in particular for correctly fitting the cover 2 to the receptacle 1 or dirt collecting devices or the like to be inserted in the receptacle 1.

On the side facing the closure plate 150, recesses 170, 171 and 172, open towards the closure plate 150, are provided in the wall section of the projection 146. A first, approximately central recess 170 serves for receiving a front plate 175 (FIG. 1), in which are located indicators for the degree of contamination of the filters positioned in the vacuum cleaner. The angle bisector 147*a* is perpendicular to the plane formed by the recess 170, thus perpendicularly to the front plate 175 held in the recess. Provided on one side, close to the recess 170 and adjacent to the edge of the projection 146, is a further identical recess 170, which in the embodiment illustrated is closed by a facing plate. Further operating members or indicators may be positioned, if necessary, in this recess 170.

Provided between the recesses 170 is a further recess 171 for receiving the main switch (on/off switch). The recesses 170 and 171 are substantially rectangular and open towards the closure plate 150.

Located on the other side of the recess 170, that is perpendicular to the angle bisector 147*a*, one half of a tube socket 174 is formed to provide a recess 172 in the form of a half shell open towards the closure plate 150. The longitudinal axis 173 of the tube socket 174 (FIG. 3) lies parallel to the angle bisector 147*a*.

Diametrically opposite the projection 146 the outer wall 142 has cooling air inlet slots 176. The inlet slots 176 are distributed over a segment angle 177 of approximately 30° in the wall section 178.

A recess 179 is provided beside this section 178 in the wall 142 for receiving a connecting member 161 (FIG. 13) for the electrical cord of the vacuum cleaner.

Across the diameter of the base plate 141—partly parallel to the angle bisector 147*a*—a lateral wall 148 is provided, which extends to the side of the longitudinal central axis 9 from the receiving cylinder 143 to the projection 146 and joins the outer wall 142 between the tube socket 174 and the central recess 170. Extending in the same way from each side of the receiving cylinder 143 towards the outer wall 142 are further lateral walls 149, the lateral walls 149 being arranged such that the section 178 of the outer wall 142 provided with the cooling air inlet slots 176 is enclosed therebetween.

The lateral walls 148 and 149 as well as the axial end of the outer wall 142 facing the closure plate 150 advantageously end at a common plane, which forms the plane of separation between the base casing 140 and the closure plate 150.

Figure 8:
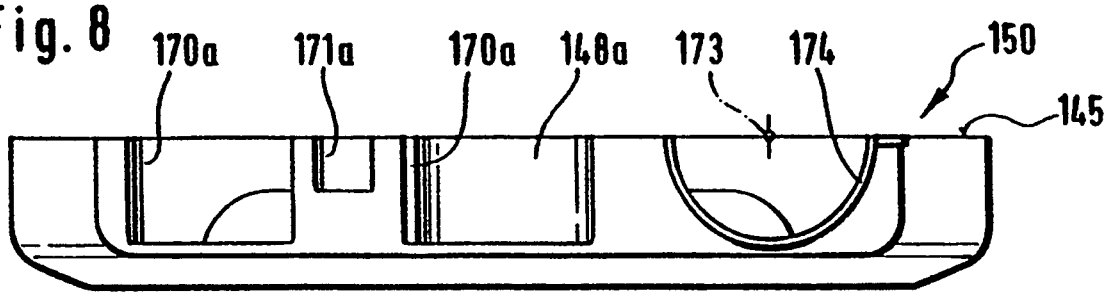
FIG. 8 is a side view of the cover viewed from the projection.
Figure 7:
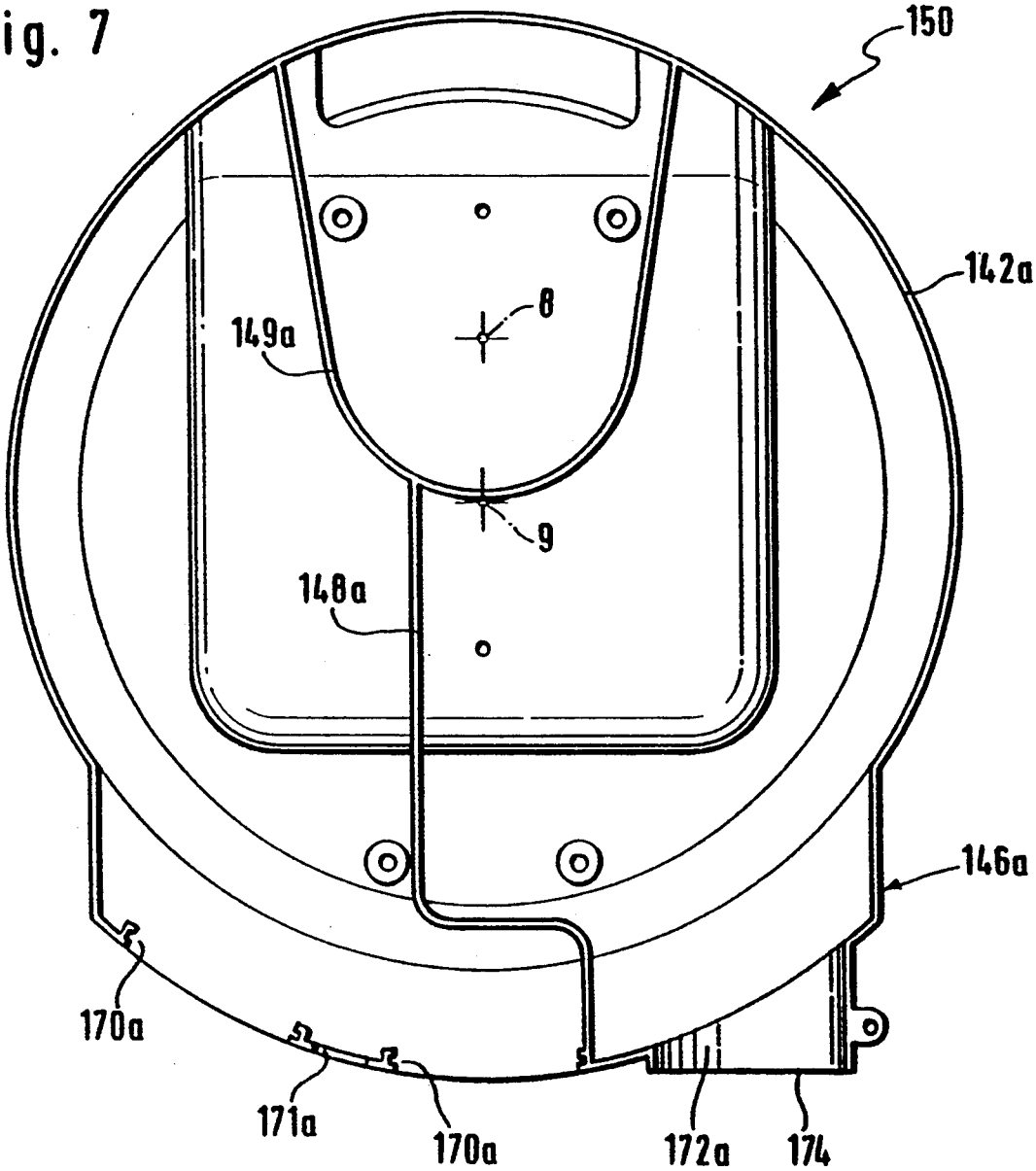
FIG. 7 is a view of the closure plate of the cover viewed from the base casing.

As can be seen from FIGS. 7 and 8, the closure plate 150 constructed in the form of a cap is provided with inner lateral walls 148*a* and 149*a*, which corresponds to the lateral walls 148 and 149 of the base casing 140. Also, the outer wall 142*a* of the closure plate 150 extends in a manner corresponding to the outer wall 142 of the base casing 140. A projection 146*a* is therefore likewise provided, in which recesses 170*a*, 171*a* and 172*a*, corresponding to the recesses 170 to 172 in the base casing 140, are present. When the closure plate 150 is fitted on the base casing 140, on the one hand, the recesses are closed and the tube socket 174 is formed by the two recesses 172 and 172*a* in the form of half shells. The terminal edges of the walls resting one on the other in a largely air-tight manner separate an air calming chamber 151 constructed between the base casing 140 and the closure plate 150 from a cooling air exhaust chamber 152 (FIG. 2).

A cooling air inlet 160 is formed in the base plate 141 of the base casing 140, whereas a cooling air outlet 153 is located in the mantle surface or wall of the receiving cylinder 143. The motor cooling air enters the cooling air exhaust chamber 152 through the cooling air outlet 153.

Also provided in the cooling air exhaust chamber 152 is a holder 159 for electronic control members and the like. The electronic control members are thus located in the cooling air stream of the motor and their adequate cooling is guaranteed.

Located in the region of the projection 146 is a cooling air outlet grid 180, which, seen in plan view in the direction toward the base plate 141—is substantially rectangular and extends largely over the entire width of the projection 146. The longitudinal central axis of the outlet grid 180 thus is perpendicular to the angle bisector 147*a*. The cooling air outlet grid 180 in this case is spaced with one longitudinal side at a short distance from the longitudinal central axis 9 of the vacuum cleaner. The lateral wall 148 divides the cooling air grid approximately in the ratio of 3:2, the greater surface area of the outlet grid 180 being associated with the air calming chamber 151.

Formed in the lateral wall 148 is a vertically extending slot 181 (FIG. 6), in which the holder 182 (FIG. 3) of a double forked light barrier 183 is held. The first fork of the light barrier is thus provided at the outlet grid on the side of the cooling air outlet chamber and the other fork of the light barrier is provided at the cooling air grid on the side of the air-calming chamber 151. Respectively, one arm of the forked light barrier thus lies on the side of the base plate 141 facing the closure plate 150 and the other arm of each forked light barrier lies on the side of the base plate 141 facing the intermediate plate 130, the arms on this side positioned at a distance from the base plate 141.

On the side of the base casing 140 (FIGS. 5, 6) facing the intermediate plate 130, the outer wall 142 is recessed over the angle 147 of the projection 146. For closing off the base casing 140 relative to the projection 146, a sealing wall 184 extending parallel to the inner longitudinal side of the cooling air outlet grid 180 is provided. The sealing Wall 184 tightly adjoins the outer partly cylindrical wall 142 of the base casing 140. From the sealing wall 184, at the location of the peripheral ends of the projection 146, side walls 185 extend approximately parallel to the narrow sides of the cooling air outlet grid 180 and terminate at a distance x before the outer wall 142. The chamber defined between the sidewalls 185, the sealing wall 184 and the outer wall 142 thus remains open by way of the slot 186 between the sidewall 185 and the outer wall 142.

Also provided in the outer wall 142, diametrically opposite each other, are recesses 190, in which closure members constructed as clips 39 can be affixed, by which the cover 2 is fixed to the receptacle 1.

The sidewalls 185, the sealing wall 184 as well as the outer wall 142 terminate axially at a common plane, which forms the dividing plane 188 with respect to the intermediate plate 130. The end 144' of the receiving cylinder 143 is set back with respect to this dividing plane 188.

Figure 6:
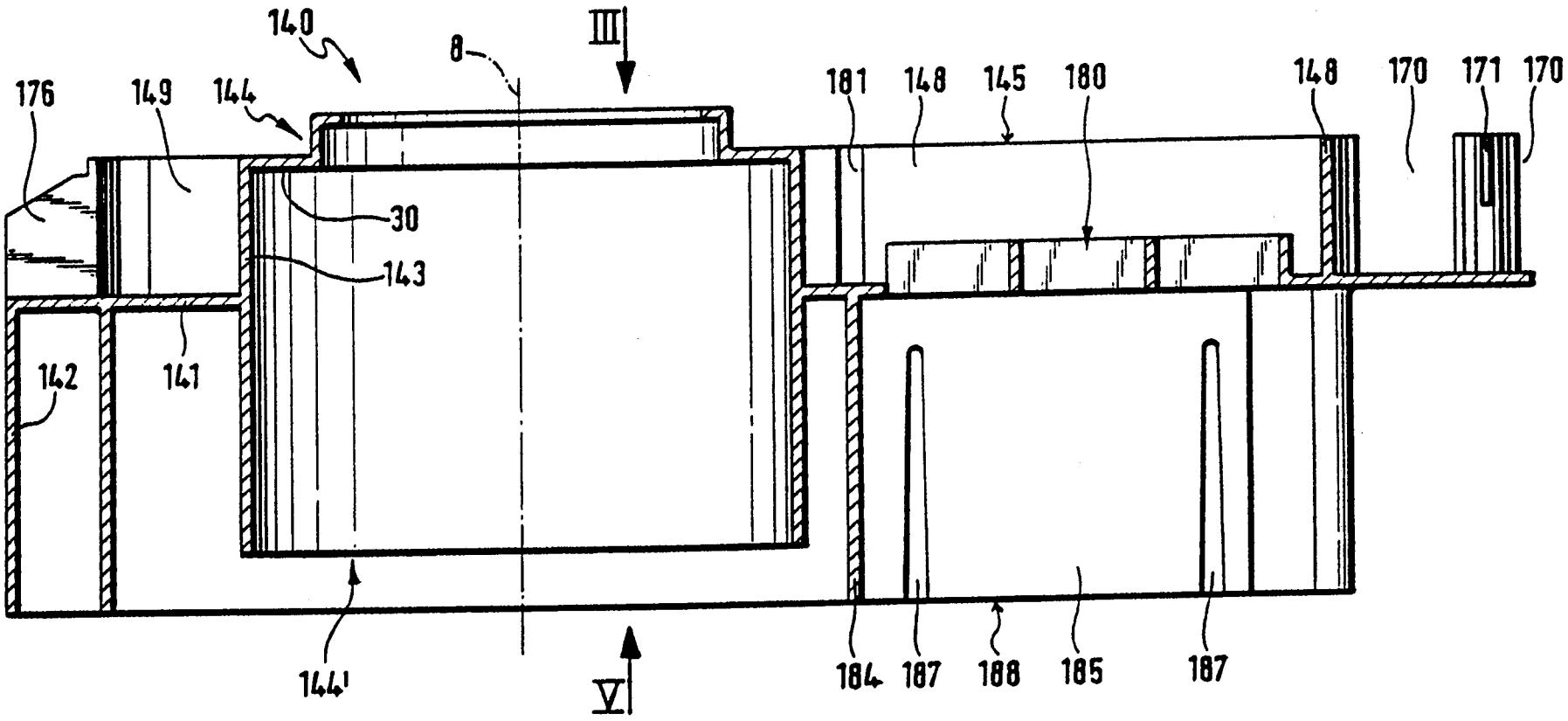
FIG. 6 is a section along the line VI—VI in FIG. 3.

As can be seen from FIG. 6, formed on the facing sides of the sidewalls 185 are guide grooves 187 extending vertically over their height, which terminate at a distance in front of the cooling air outlet grid 180 and are open towards the dividing plane 188. The guide grooves 187 advantageously taper towards their blind ends.

Figure 5:
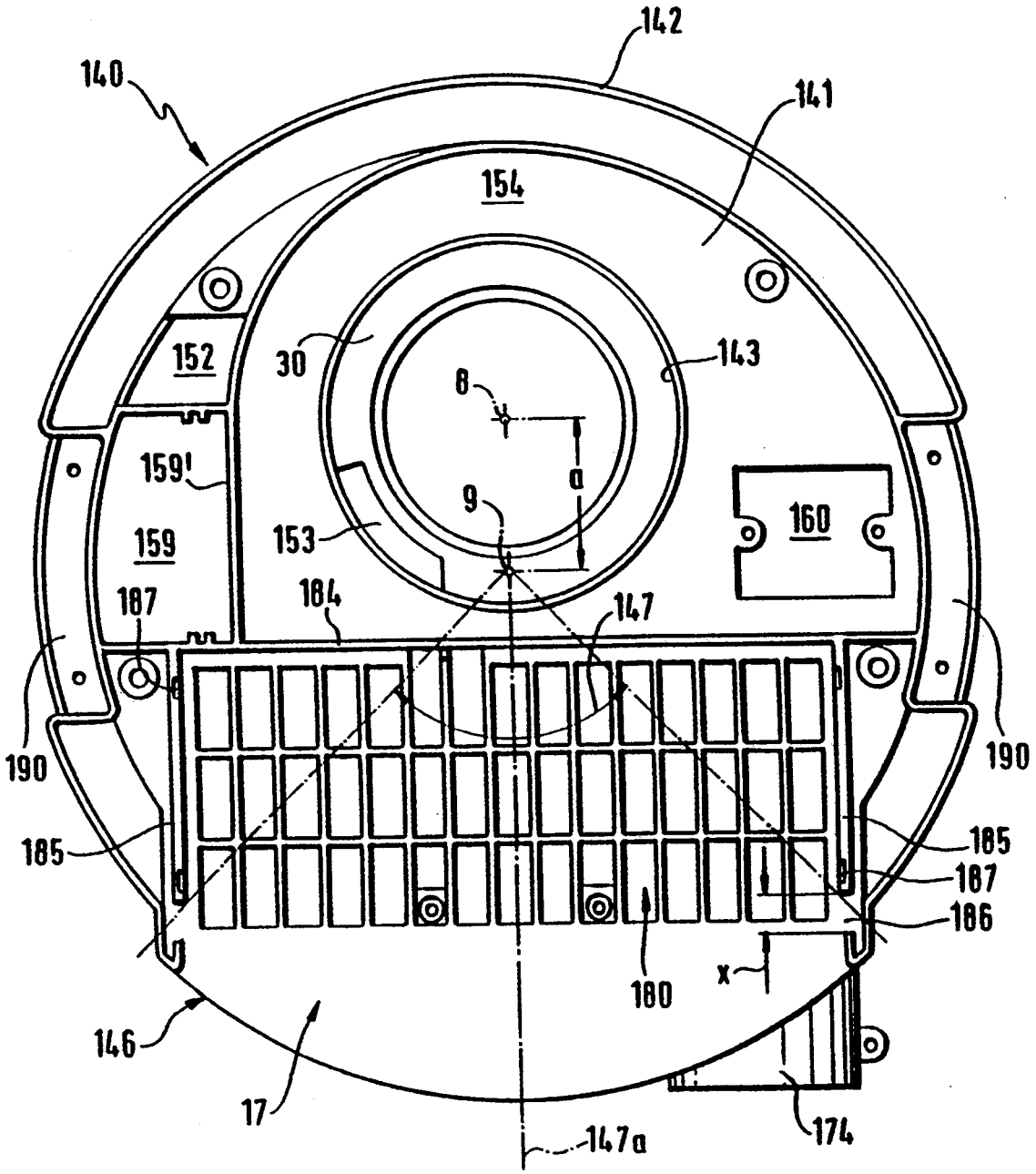
FIG. 5 is a view of the base casing in the direction of arrow V in FIG. 4.

As can be seen from FIGS. 3 and 5, the holder 159 extends over the height of the base casing 140 in the direction toward the intermediate plate 130. The inner wall 159' facing the cylinder 143 is elongated into a semicircular shape with a transition into the outer wall 142 thus defining the air guiding chamber 154.

Figure 9:
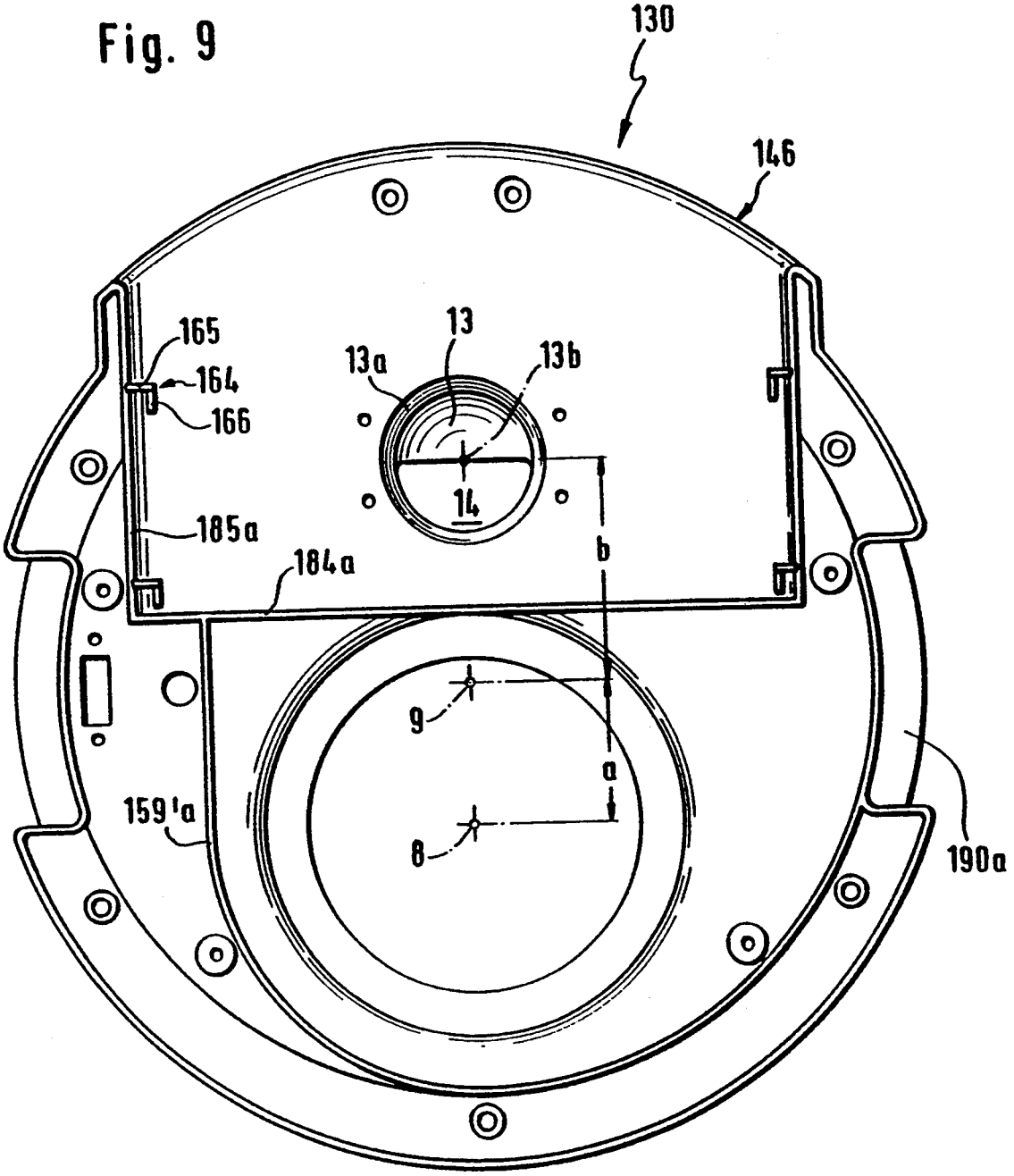
FIG. 9 is a plan view of the intermediate plate facing the base casing.
Figure 10:
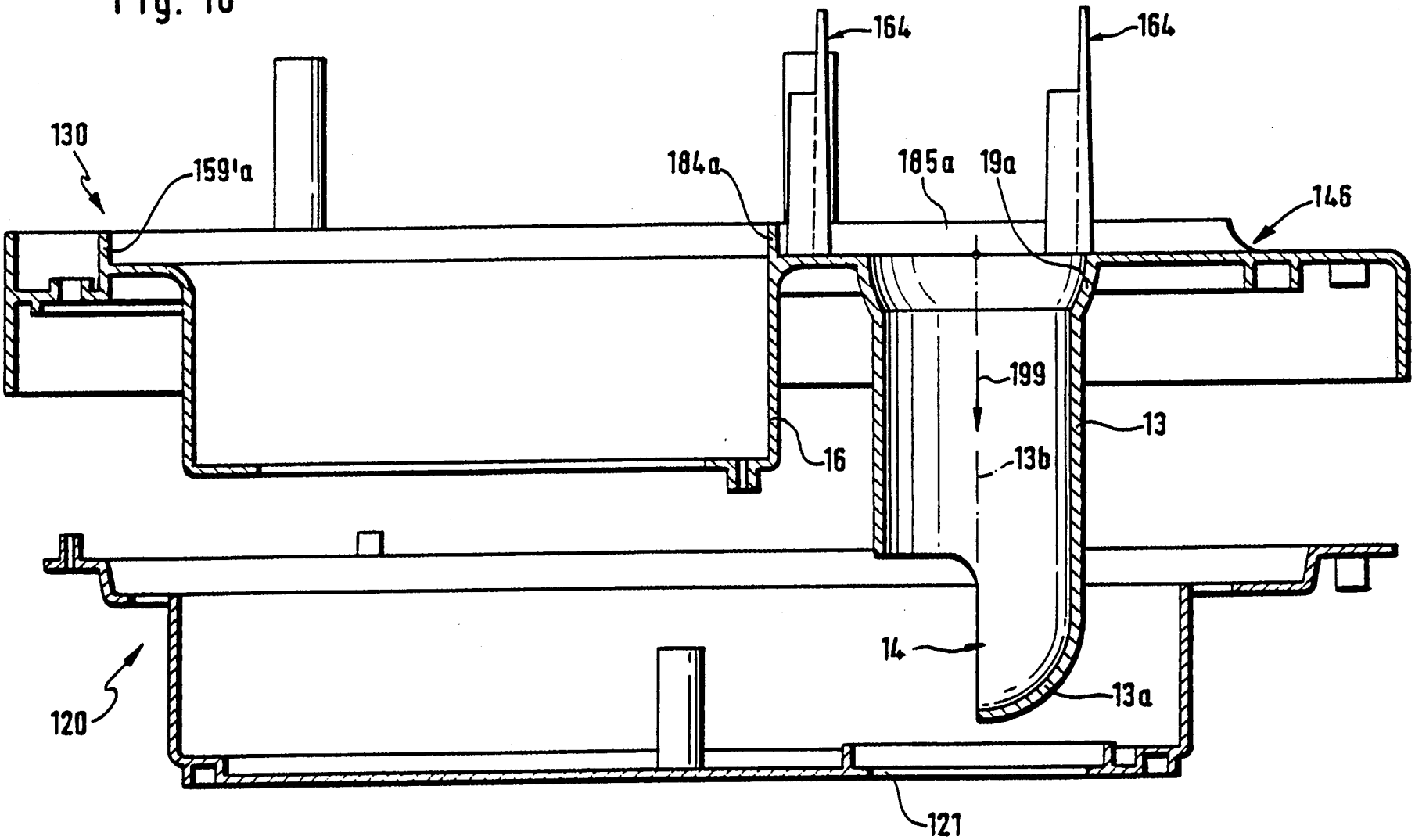
FIG. 10 is a section through the intermediate plate with coordinated base plate.

The intermediate plate 130, illustrated in FIG. 9 in plan view viewed from the base casing 140 and shown in cross-section in FIG. 10, comprises stays 184*a* and 185*a* corresponding to the sealing wall 184 and the sidewall 185, so that when the intermediate plate 130 is fitted on the base casing 140, the sidewalls 185, the sealing wall 184, the base plate 141, and the intermediate plate 130 define a passage 17, which opens radially outwardly. The air guiding chamber 154 is sealed hermetically toward the outside by a correspondingly provided stay 159'*a*.

In the region of the projection 146, the intermediate plate 130 comprises stays 164 extending perpendicularly to the plate 130, which, seen in plan view, have an angular cross-section. One leg 165 in this case engages over its entire height the associated guide groove 187 in the sealing wall 185 of the base casing 140. The other leg 166 thus faces the sealing wall 184.

The intermediate plate 130 is provided with a cylindrical, cup-shaped compartment 16 offset by a distance a with respect to the longitudinal central axis 9. The compartment 16 extends essentially axially on the side of the intermediate plate 130 remote from the base casing 140 and has a larger diameter than the receiving cylinder 143 of the base casing 140, as shown in FIG. 2.

A partial half-shell 19*a* of a ball-and-socket joint 19 is constructed in the region of the intermediate plate 130 that is opposite the air outlet grid 180. The half shell 19*a* is spaced equally between the sealing wall 185 on either side, respectively, the stays 185*a* of the intermediate plate 130 and has a spacing b from the longitudinal central axis 9. Adjoining the partial half-shell 19*a* is an inlet channel 13 with an outlet opening 14 that faces the longitudinal central axis 9. This is achieved by closing off the free end the inlet channel 13 with a spherical partial shell 13*a*, due to which in the region of the outlet opening 14 air flowing in the direction of arrow 199 in the longitudinal direction of the inlet channel 13 is deflected slightly obliquely towards the base of the receptacle 1 approximately in the direction of the longitudinal central axis 9 of the vacuum cleaner.

The bottom plate 120 of the cover 2 is fitted on the intermediate plate 130, thereby defining a suction chamber 15 between the bottom plate 120 and the intermediate plate 130. The inlet channel 13 passes through an opening 121 in the base plate 120. A sealing ring, in particular a soft sealing ring, is advantageously fitted to the projecting end of the inlet channel 13 and air-tightly seals the gap between the base plate 120 and the inlet channel 13.

Figure 11:
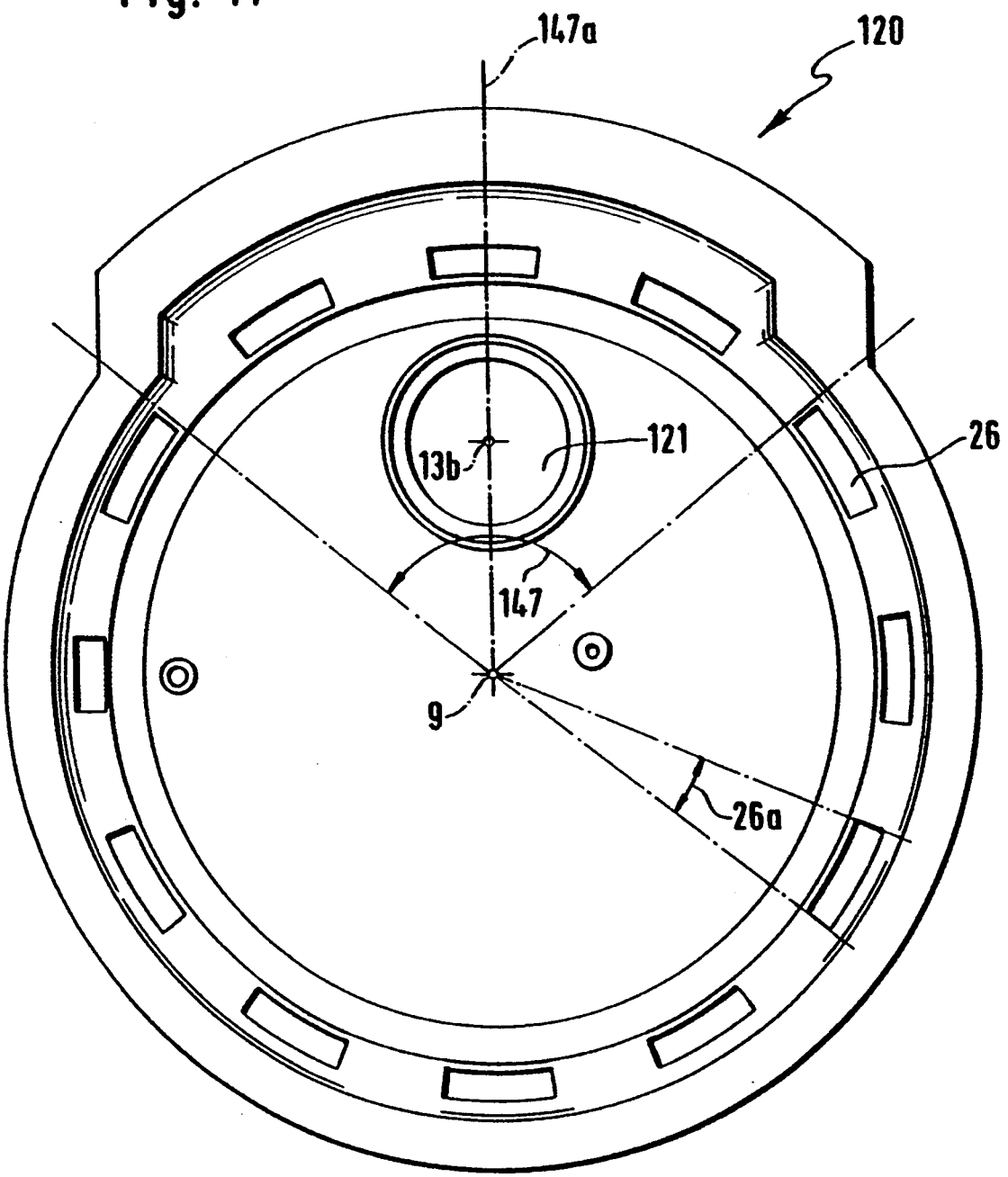
FIG. 11 is a plan view of the base plate according to FIG. 10.

As can be seen from the plan view according to FIG. 11, the bottom plate 120, its shape corresponding basically to the intermediate plate 130, the base casing 140, and the closure plate 150, is provided in the edge region, over its periphery, with a plurality of inlets 26, through which air may flow into the suction chamber 15. The inlets 26 extend over a segment angle 26*a* of approximately 15° and are distributed over the periphery at equidistant intervals. Advantageously, the intervals between two adjacent inlets 26 correspond to the segment angle 26*a*.

As shown in FIG. 2, the electrical drive motor 3 is located in the receiving cylinder 143 of the base casing 140, which thus serves as the motor compartment 4. The motor 3 is supported at the open end 144 of the receiving cylinder 143 on a resilient bearing ring 5, which preferably rests on the shoulder 30 of the open end 144.

At the opposite end, the motor 3 is connected to a suction fan 7, which is held in the cup-shaped compartment 16 of the intermediate plate 130. Advantageously, the suction fan 7 is supported on a resilient bearing ring 6 at the bottom of the compartment 16 or at an annular edge of the compartment. Provided on the side of the suction fan 7 facing the motor 3 is a corresponding resilient bearing ring 6, which engages over the edge of the suction fan 7 and on which the edge of the open end 144' of the receiving cylinder 143 rests. The vertical axis 8 of the drive motor 3 has a common major axis 8 with the attached suction fan 7. This axis 8 is spaced at a horizontal distance a from the vertical longitudinal central axis 9 of the vacuum cleaner (FIG. 5). In this case, the major axis 8 lies on the angle bisector 147*a*. The passage 17 of the cover 2, diametrically opposite the electric drive motor 3 relative to the longitudinal central axis 9, is open radially outwardly over the entire segment angle 147. In the direction of the longitudinal central axis 9, it has an axial height h and receives an angular, preferably rectangular, suction socket 10, to which the suction hose 11 with a cleaning tool (not shown in detail) can be connected.

The free end of the angular section 12, remote from the suction hose 11 and parallel to the longitudinal central axis 9, has a partially spherical part 25, which is positioned in the partial half-shell 19*a* provided at the bottom 18 of the passage 17. The partially spherical part 25 is fixed in position by a closure part 24 that corresponds to the partial half-shell 19*a*. The free end of the suction socket 10 or of the angular section 12 of the suction socket 10 remote from the suction hose 11 is thus mounted in a ball-and-socket joint 19 and therefore is able to rotate about the longitudinal central axis 13*b* of the inlet channel 13 that adjoins the bottom 18 of the compartment 17 and tilt within the clearance range of the suction socket 10 in the passage 17 (height h). When upon producing a vacuum an air stream flows in the direction of arrow 199, the spherical part 25 is drawn into the partial half-shell 19 due to the vacuum, so that, as a whole, the mobility of the suction socket 10 is dampened when the vacuum cleaner is in operation.

On account of the dimensions of the passage 17, the suction socket 10 is able to tilt horizontally as well as vertically about the center of the ball 19*b* due to the ball-and-socket joint 19. This has the advantage that in an operating region of a vacuum cleaning tool connected to the vacuum cleaner, determined by the tilting range of the suction socket 10, the vacuum cleaner must not be moved and thus remains stationary. On the one hand, convenient operation without the danger of the vacuum cleaner tipping over is therefore guaranteed; on the other hand, the mechanical/dynamic loading of the bearings of the motor shaft on account of the Giro effect, occurring at the time of movements of the vacuum cleaner, is reduced. The eccentric location of the drive motor 3 and of the suction fan 7 also contributes to reducing the danger of the vacuum cleaner tipping over, since the center of gravity of the drive unit lies approximately diametrically opposite the suction socket 10. Furthermore, the receptacle 1 is provided at the bottom with several rollers 51, in particular four rollers, which are positioned at equal intervals in the peripheral direction. One of the rollers 51 in this case lies exactly centrally below the chute 17, thus directly below the suction socket 10, thereby further reducing the danger of tipping over.

Figure 12:
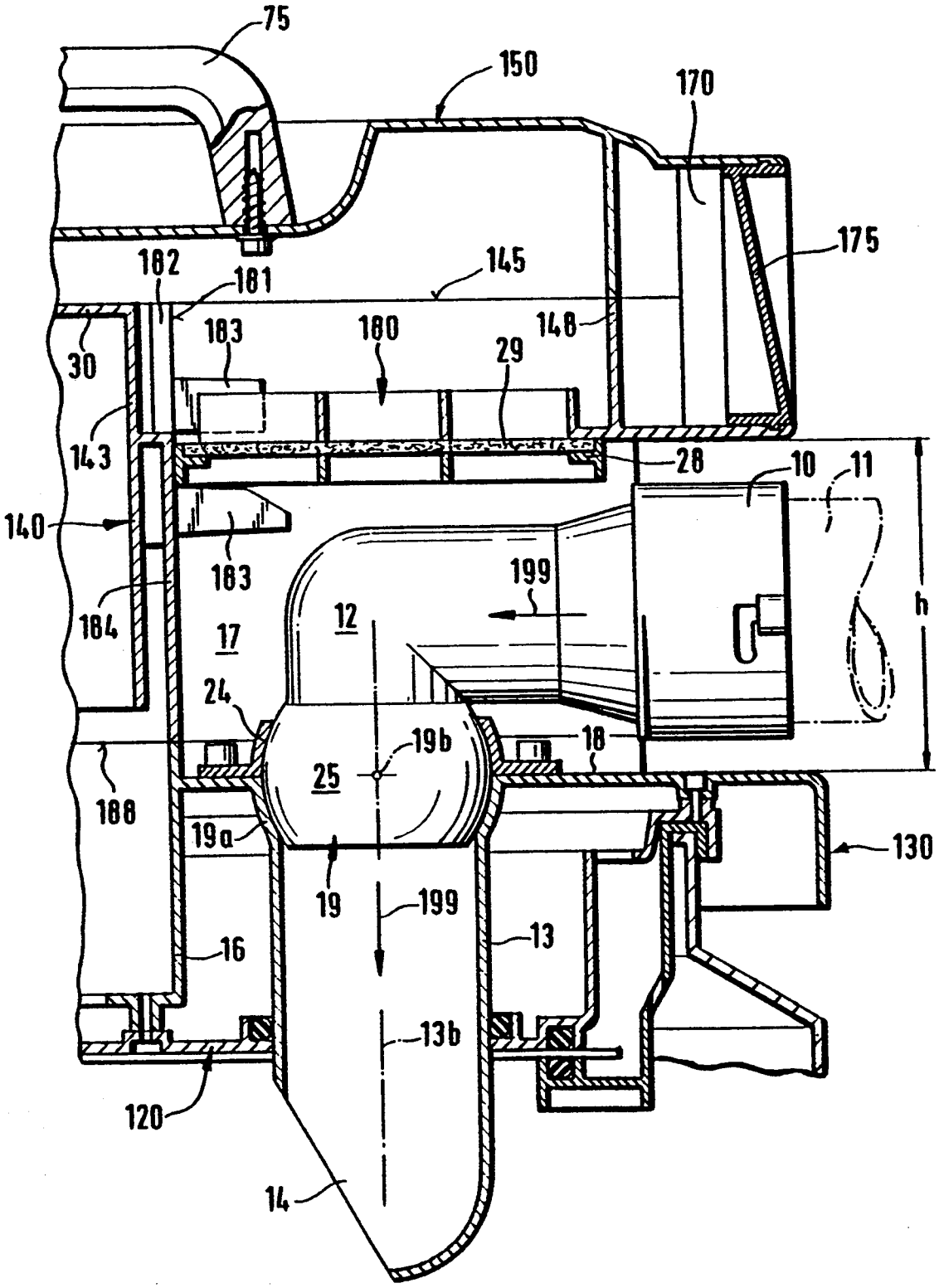
FIG. 12 is a part-sectional view of the passage of the vacuum cleaner at the level of the suction socket.

When the drive motor 3 is operating, the suction fan 7 sucks in air from the receptacle 1 via the inlets 26 and the suction chamber 15. As shown in FIG. 12, the dirt-laden intake air stream flows to the receptacle 1 by way of the suction socket 10 and is first deflected by preferably 90° in the angular section 12, so that the dirt particles entering with high kinetic energy lose their kinetic energy due to the deflection. The intake air stream flows by way of the angular section 12 into the inlet channel 13 and is again deflected by approximately 90° in order to be discharged from the outlet openings 14, due to which the dirt particles conveyed lose further energy. From the outlet opening 14, the dirt-laden intake air stream flows approximately transversely and slightly inclined with respect to the longitudinal central axis 9 into the receptacle 1, where the dirt particles carried by the intake air stream are filtered out and retained in a filter described in further detail hereafter. Due to the closure of the outlet opening 14 of the inlet channel 13 in the shape of a quarter of a sphere, it is ensured that despite the eccentric supply of the dirt-laden intake air stream, the regions of the filter directly adjacent to the inlet channel 13 are not directly impacted, so that there is no risk that particles that may still have high kinetic energy penetrate the filter wall, resulting in a great loss, possibly even complete elimination, of the filtering action.

The filter illustrated in the embodiment in FIG. 2 consists of a support ring 23, which rests on a support edge 21 of the receptacle 1. Located between the wall of the receptacle and the filter 27 is the clean air chamber 50, which is closed towards the cover 2 by the support ring 23. The support ring 23 comprises a plurality of discharge openings 22 distributed over its periphery in the edge region. The openings 22 guarantee a uniform discharge of the clean air about the periphery of the filter 27. It is thus also ensured that the filter is loaded substantially uniformly over its entire filtering surface.

The discharge openings 22 open into a throughflow chamber 20, which is formed between the support ring 23 and the bottom plate 120 of the cover. Clean air passes into the suction chamber 15 of the suction fan 7 by way of the inlets 26 provided in the edge region of the cover 2. The size and number of the discharge openings 22 in the support ring 23 appropriately correspond to the construction of the inlets 26; the plurality of discharge openings 22 or inlets 26 is arranged such that flow-technologically, a type of annular air inlet is produced, which guarantees largely uniform flow conditions over the entire periphery of the filter 27.

Figure 13:
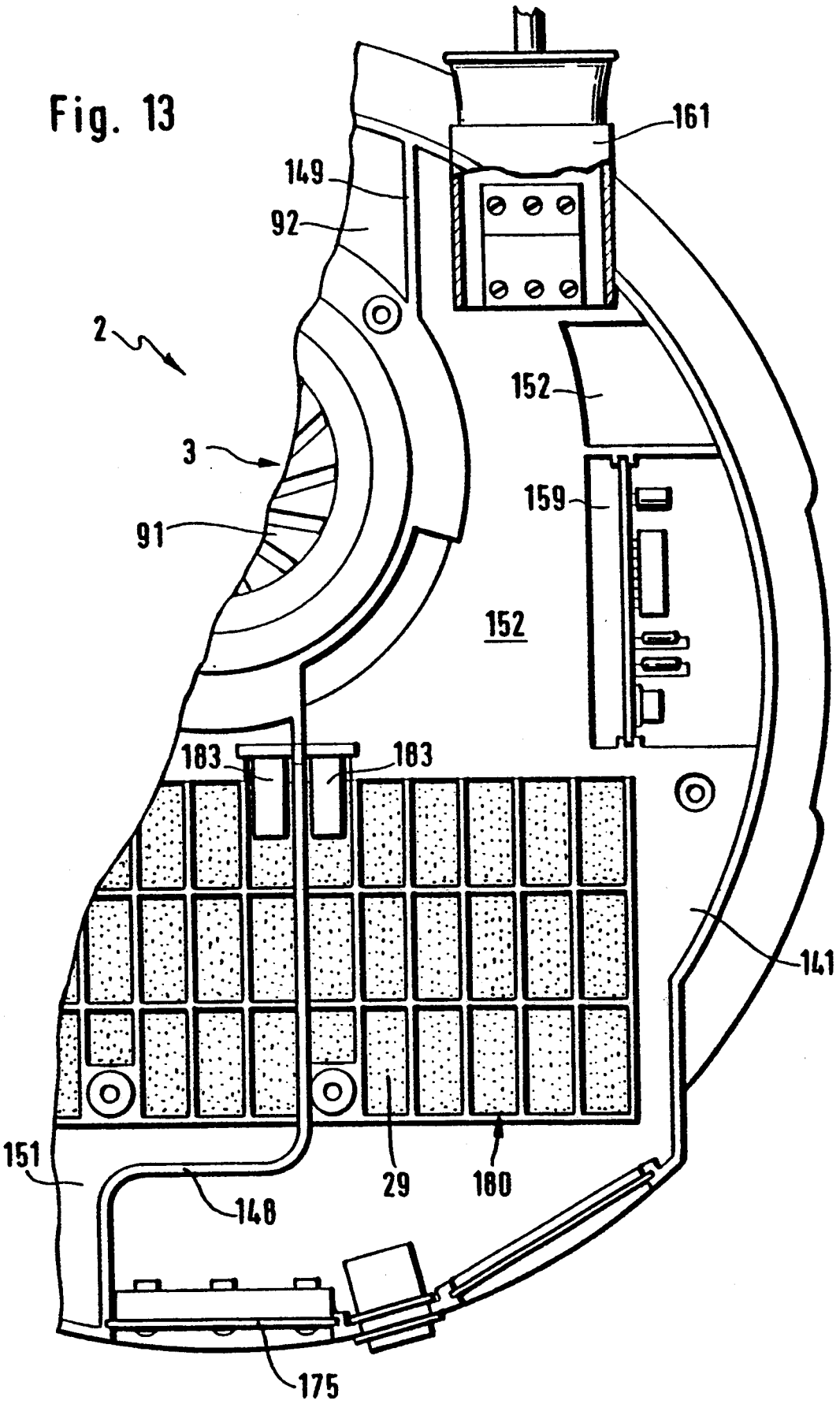
FIG. 13 is a part-sectional view of the cover providing a plan view of the exit filter.

The air stream is sucked by the suction fan 7 from the suction chamber 15 into the air guiding chamber 154 and is able to expand there. The air then flows through the air inlet opening 160 into the air calming chamber 151 and is exhausted in a diffused manner through the air outlet grid 180 and the passage 17. The air outlet grid 180 forming the lid of the passage 17 is covered by an outlet filter 29. The outlet filter 29 is a filter mat, preferably an electret filter, which is laid on a support 28. The support 28 is inserted radially into the passage 17 whereby it is guided on the free ends of the stays 164. The outlet filter 29 advantageously is positioned between the air outlet grid 180 and the support 28. The arms of the double forked light barrier 183 in this case engage through the outlet filter 29, thus providing the possibility of monitoring the dirt collected on the outlet filter 29. FIG. 13 shows the position of the double forked light barrier 183 inside the cover 2, and FIG. 12 shows the position of the double forked light barrier 183 in the region of the passage 17. FIG. 13 also shows clearly that both the loading with dirt of the filter mat section filtering the exhaust air stream is monitored as well as the filter mat section filtering the cooling air flow from the cooling air outlet chamber 152.

Figure 14:
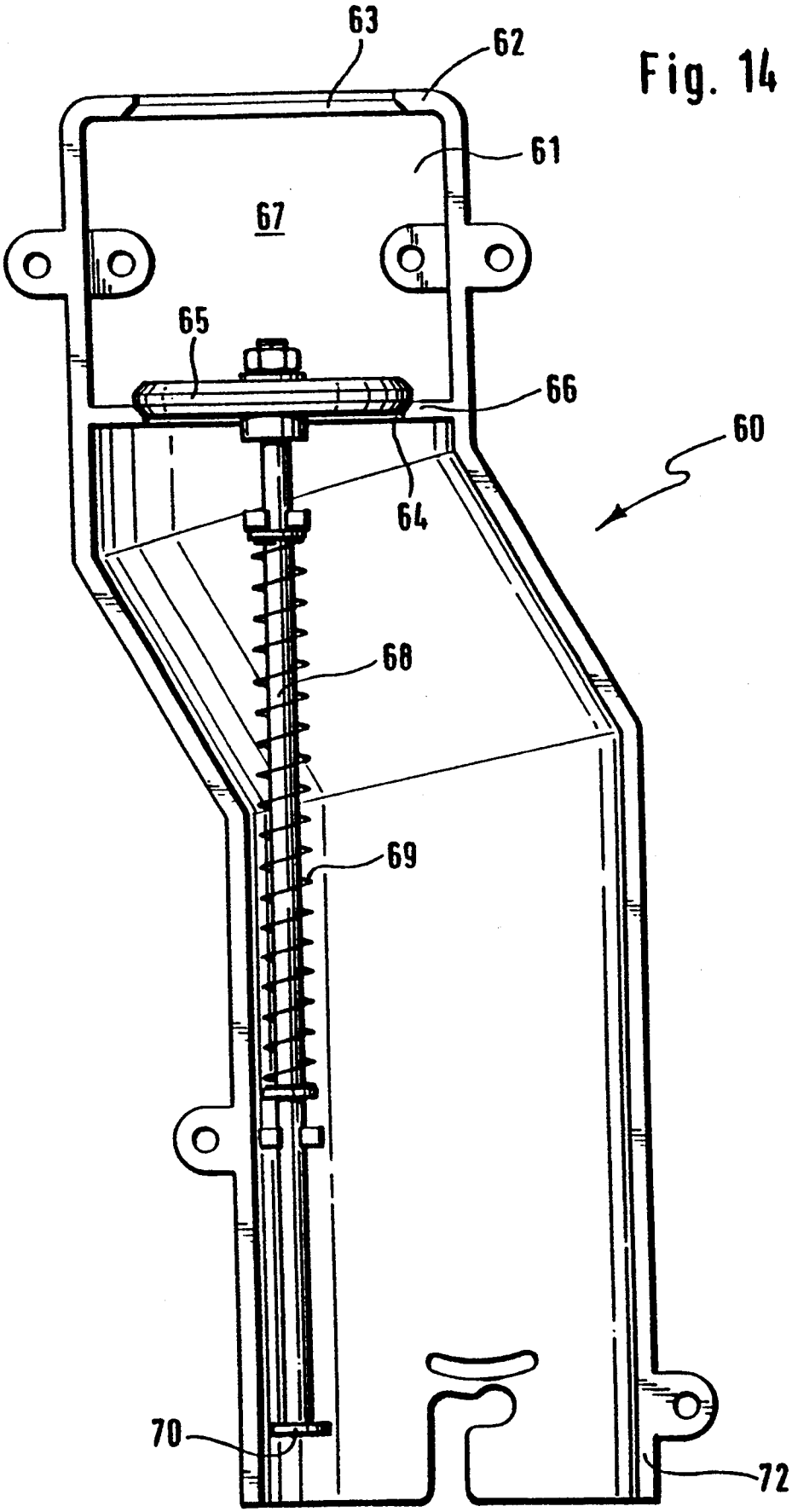
FIG. 14 is a section of the cover with its exhaust socket.

Not only can the intake air stream be blown out by way of the air calming chamber 151 in a diffused manner through the air outlet grid 180 and the passage 17, but also in a directed manner by way of an air exhaust socket 60 (FIG. 14). The air exhaust socket 60 having a valve chamber 61 with an opening 67 at the bottom (FIG. 2) is located above the air inlet opening 160 in the base plate 141 of the base casing 140. The air exhaust socket 60 discharges the air stream coming from the air-guiding chamber 154 directly through the valve chamber 6 and through the recess 172 constructed as a tube socket 174 to the exterior. In two opposite walls 62 and 66 of the valve chamber 61 throughflow openings 63 and 64 are provided, which can be closed off alternately by a valve plate 65. The valve plate 65 can be actuated by a valve rod 68, which is guided in the longitudinal direction of the air exhaust socket 60 and lies with its front end 70 within an area of the connecting collar 72 of the air exhaust socket 60. The connecting collar 72 is connected in an air-tight in the tube socket 174, preferably by inserting a gasket. An air exhaust hose is inserted into the connecting collar 72.

If no air exhaust hose is connected to the air exhaust socket 60, the valve rod 68 is moved by the force of the spring 69 into the position shown in FIG. 14. The valve plate 65 closes off the opening 64, due to which the exhaust air stream may pass from the air guiding chamber 154 by way of the opening 63 into the air calming chamber 151 and escapes in a diffused manner through the air outlet grid 180. When an air exhaust hose is inserted into the connecting collar 72 of the air exhaust socket 60 and secured in the manner of a bayonet closure, the forward end face of the air exhaust hose moves the valve rod 68 against the force of the spring 69, so that the valve plate 65 closes off the opening 63 and the exhaust air escapes from the air guiding chamber 154 directly through the opening 64 into the air exhaust socket 60.

The cooling air stream for the motor 3 is produced by a cooling air fan 91, which is located on the end of the motor shaft facing the closure plate 150 in the opening of the end 144 of the receiving cylinder 143. It sucks cooling air from the cooling air chamber 92, defined between the lateral walls 149 (FIG. 3), the stays **149*a* (FIG. 6), the receiving cylinder 143, the base plate 141, and the closure plate 150 to the motor 3 in the receiving cylinder 143, from which the now heated cooling air escapes via an opening 153 into the cooling air exhaust chamber 152 in order to exit in a diffused manner through the air outlet grid 180. Cool fresh air flows into the cooling air chamber 92 through the cooling air inlet slots 176 (FIG. 3). The cooling air stream is thus produced and guided separately from the intake air stream and any carbon dust or the like which is carried along is removed by the surface of the outlet filter 29**.

The vacuum cleaner according to the invention can be operated with different filter inserts both as a "dry" vacuum cleaner for solids or also as a "wet" vacuum cleaner for liquids.

In the embodiment illustrated (see in particular FIG. 2), the filter 27 is suspended in the receptacle 1. The support ring 23 comprises a U-shaped edge 33, by which the support edge 21 of the receptacle 1 is overlapped. A filter cylinder 31 may be arranged on an inner retaining ring 34, which is constructed with a smaller diameter than the U-shaped edge 33. The filter cylinder 31 expediently consists of a perforated wall 32. Suspended in this filter cylinder 31 is an exchangeable filter bag 35, which has horizontal folds in the manner of a so-called accordion fold. The end ring 36 of the filter bag 35 rests on a sealing ring 37, which is positioned in the retaining ring 34. As shown in FIG. 2, a further sealing ring 38 is provided in the bottom plate 120 opposite the sealing ring 37, so that when the cover 2 is placed on the receptacle (FIG. 2), the end ring 36 is held in an air-tight manner between the two sealing rings 37 and 38. The cover 2 is held on the receptacle 1 by two clips 39 arranged diametrically opposite each other and ensuring accurate and air-tight fixation of the cover 2 to the receptacle 1. In this case the clips 39 engage below the support edge 21.

Figure 15:
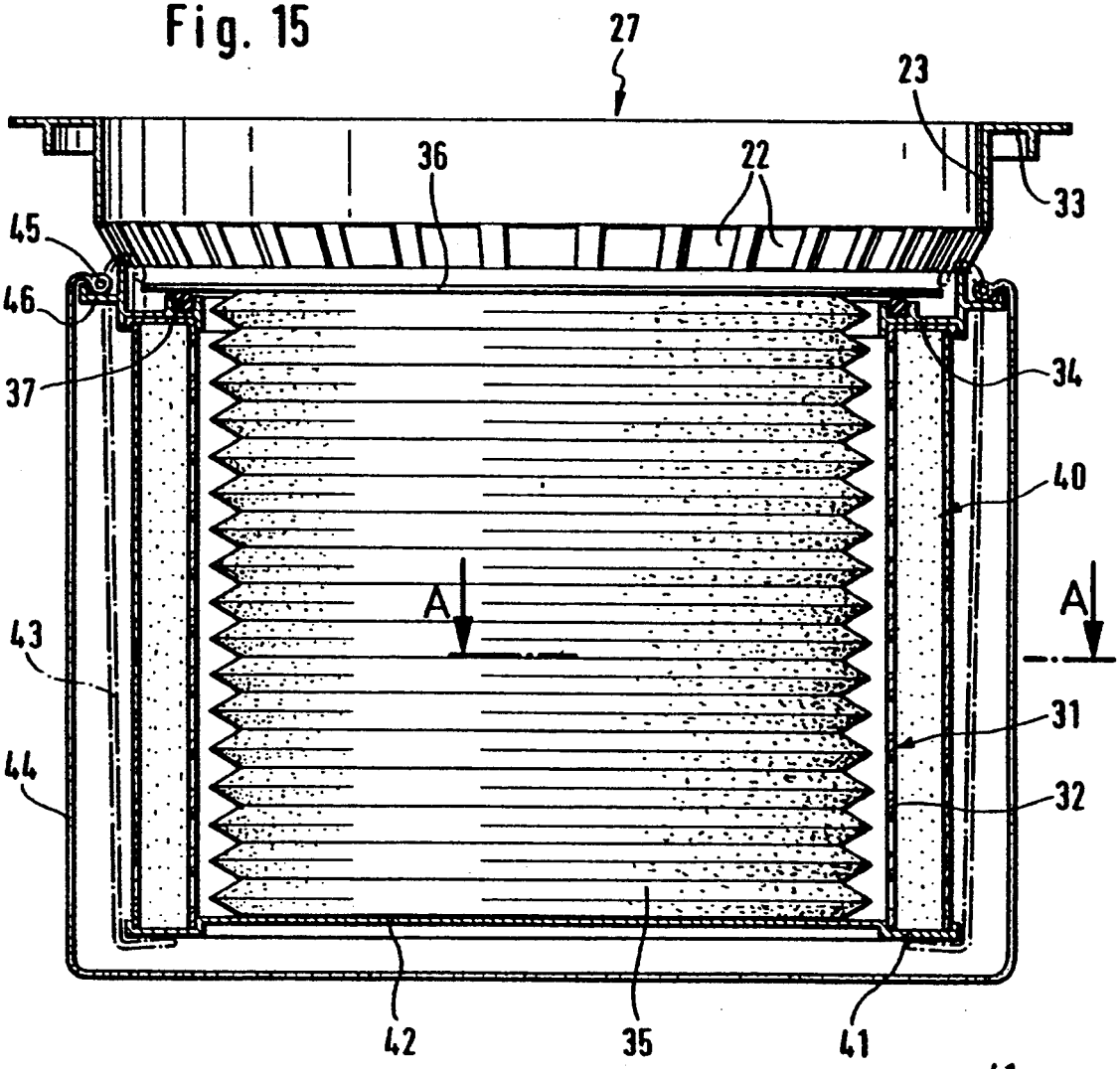
FIG. 15 is a section through one of the filter elements.
Figure 16:
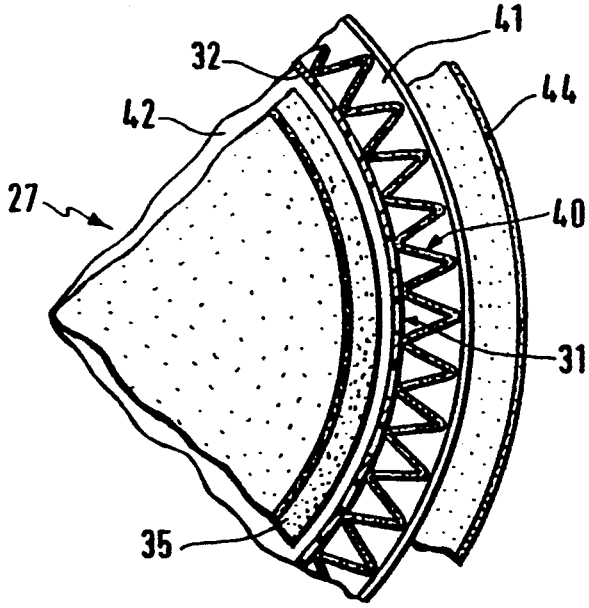
FIG. 16 is a part-sectional view of the filter element according to arrow A in FIG. 15.
Figure 17:
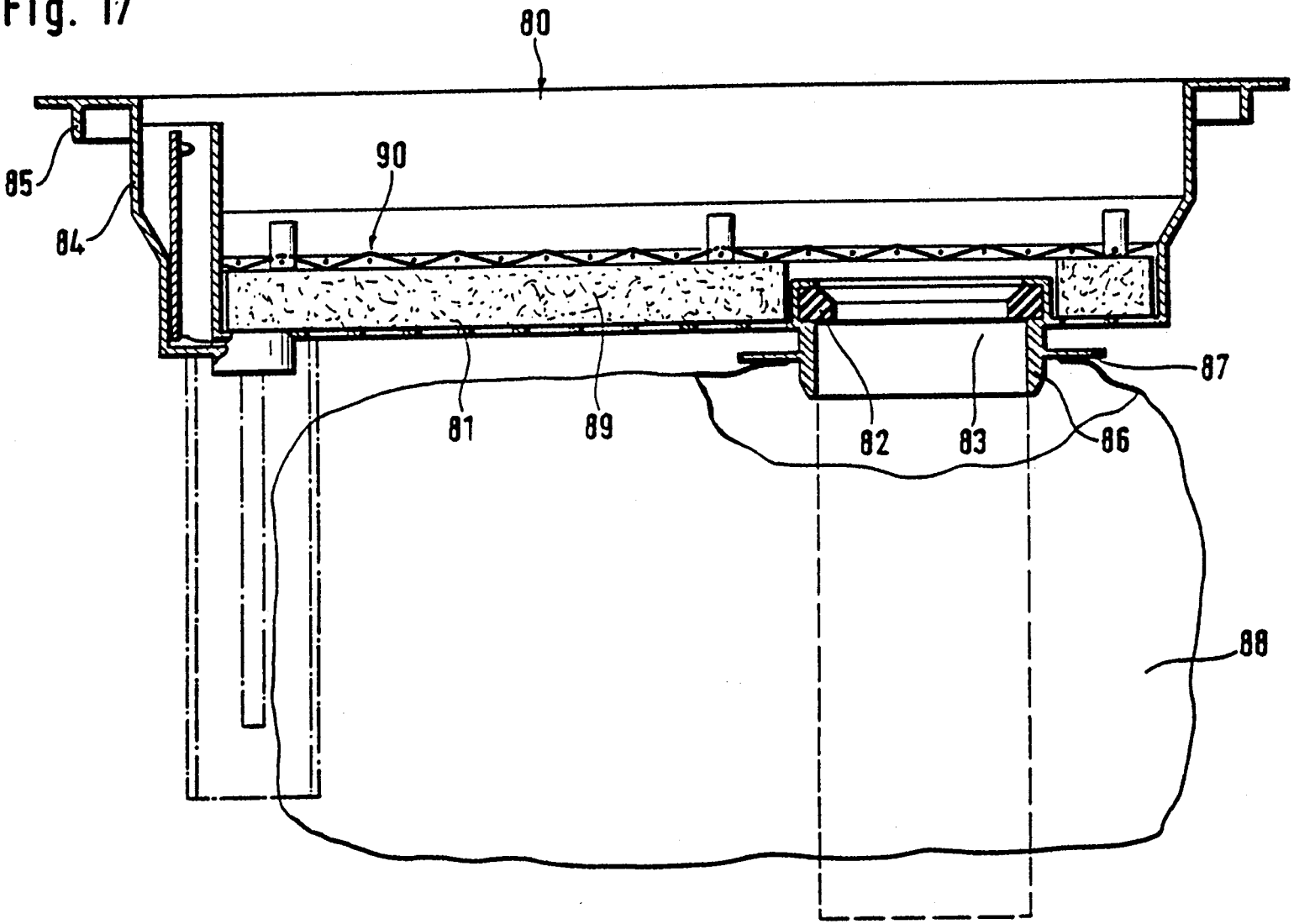
FIG. 17 is a section of a further filter element.

The filter illustrated in FIG. 15 can be supplemented by a further filter surrounding the filter cylinder 31. This further filter is constructed as a so-called filter cartridge 40 with vertical folds (FIG. 16) parallel to the longitudinal central axis. At its front end facing the retaining ring 34, the filter cartridge 40 is supported on the retaining ring 34 itself and at the opposite end is retained by the projecting edge 41 of a filter end plate 42. The filter end plate 42 can be secured axially on the support ring 23 by clips 43, so that an inner filter cylinder 31 is dispensable.

In order to achieve high dirt retention, it may be appropriate to position the filter cylinder 31 with the filter cartridge 40 surrounding it and the filter bag 35 suspended in the filter cylinder 31 in a third filter, which in the shown embodiment is constructed as a filter bag 44. Advantageously, a filter bag 44 of this type is fixed to an outer angle ring 46 for example by a pull cord 45. The outer angular ring 46 may be fixed, for example, to the outer side of the support ring 23 facing the wall of the receiving drum. Filtering is thus achieved with a high degree of retention even of the smallest particles of dust.

In a further development of the invention, a control device is located in the cover 2, which automatically stops the vacuum cleaner in the case of a correspondingly high loading of dirt of a filter in the receptacle 1. Thus, as shown in FIG. 2, by means of a further forked light barrier 52, a vertical fold of the filter cartridge 40 is monitored. The circuit board 53 supporting the forked light barrier 52 has contact points at its end facing the cover 2, against which contact points contact springs bear when the cover 2 is attached. The contact springs are arranged, for example, in a corresponding contact pin 54, which projects through the intermediate plate 130 and is attached to the bottom of the holder 159. The electronic circuits forming the control device, mounted on a circuit board, are inserted into the holder 159. If the folds of the filter cartridge which are monitored, become clogged with dirt, the passage of light to the forked light barrier is reduced, whereupon the control device responds and switches off the motor 3 and thus the vacuum cleaner. The state of the filter is indicated optically on the front plate 175 (FIG. 1) in the cover 2 of the housing. The outlet filter 29 is monitored in the same way by the double forked light barrier 183.

In a simple embodiment, in place of the filter 27 with the filter cylinder 31, a filter shell can be inserted in the receptacle 1, which due to a retaining ring 84 is provided with a U-shaped edge 85 engaging over the edge of the receptacle 1. The base 81 of the filter shell 80 has a smaller diameter than the overlapping edge 85 and is constructed in the manner of a sieve. The base 81 has a passage 83 for the passage of the inlet channel 13, which is equipped with a sealing ring 82, which engages hermetically around the projecting inlet channel 13. Adjoining the passage 83 is a socket 86 arranged in the receptacle, which socket is preferably constructed in one piece with the base 81. The socket 86 comprises an outer annular flange 87, which serves for the mounting of a filter bag 88. In the embodiment illustrated, a filter mat 89 is placed on the base 81, which mat is secured by a retaining grid 90 located thereabove. The filter mat 81 is preferably constructed as an electret filter and serves for filtering out particles of dust, which pass through the filter bag 88. The filter mat 81 can also advantageously be constructed as an odor-absorbing filter.

When the filter bag 88 is omitted and the filter shell 80 is employed, the vacuum cleaner according to the invention can be used as a "wet" vacuum cleaner. In order to monitor the filling level and to guarantee a timely switching-off of the cleaner the socket 86, as shown in broken line in FIG. 17, may be extended and contain a float arrangement, which closes an electrical contact when the full state is reached. The transmission of the electrical contact signal may take place with contacts and contact springs according to the transmission of the signals from the forked light barrier 52 (FIG. 2).

The present invention is, of course, in no way restricted to the specific disclosure of the specification and drawings, but also encompasses any modifications within the scope of the appended claims.

What I claim is:

1. A vacuum cleaner comprising:

a receptacle;

a cover, for closing said receptacle, having a radially open passage;

a drive motor connected to said cover;

a suction fan, producing a suction air stream that is guided via said suction socket into said receptacle and removed from said receptacle, connected to said cover;

an angular suction socket positioned within said passage, said angular suction socket having a first leg for receiving a suction hose, said first leg extending radially with respect to a longitudinal central axis of said vacuum cleaner, and a second leg extending substantially vertically into said receptacle at a distance from said longitudinal central axis, said second leg connected to said passage at an end of said passage proximal to said longitudinal central axis so as to be vertically and horizontally tiltable; and wherein said motor has a vertical axis and said suction fan has a vertical axis coinciding with said vertical axis of said motor, with said vertical axis of said motor and said vertical axis of said suction fan spaced at a distance to said longitudinal central axis of said vacuum cleaner.

2. A vacuum cleaner according to claim 1, further comprising a ball-and-socket joint for tiltably connecting said second leg of said suction socket to said passage.

3. A vacuum cleaner according to claim 2, wherein said cover is comprised of a base casing with a lower and an upper end a bottom plate connected to said lower end of said base casing and facing said receptacle a closure plate connected to said upper end, and an intermediate plate connected in said base casing so as to be positioned between said bottom plate and said closure plate, wherein said motor is positioned within said base casing and said suction fan is supported on said intermediate plate, and wherein said passage is delimited by said base casing and said intermediate plate.

4. A vacuum cleaner according to claim 3, wherein said intermediate plate forms a bottom of said passage and wherein said ball-and-socket joint comprises a first and a second partial half-shell connected to said intermediate plate, wherein said second leg of said suction socket has a partially ball-shaped free end inserted into said first and said secondpartial half-shells as a counter part to said first and second partial half-shells of said ball-and-socket joint.

5. A vacuum cleaner according to claim 4, further comprising an inlet channel connected to said first partial half-shell, said inlet channel extending into said receptacle.

6. A vacuum cleaner according to claim 5, wherein said first partial half-shell and said inlet channel form a unitary part.

7. A vacuum cleaner according to claim 4, wherein said passage has a top portion opposite to said bottom, said top portion having an air outlet for the suction air stream.

8. A vacuum cleaner according to claim 7, wherein said air outlet comprises an outlet filter.

9. A vacuum cleaner according to claim 4, wherein said passage has a top portion opposite to said bottom, said top portion having an air outlet for a cooling air stream.

10. A vacuum cleaner according to claim 9, wherein said air outlet comprises an outlet filter.

11. A vacuum cleaner according to claim 1, wherein said passage extends over an angular distance of substantially 90° in a circumferential direction of said cover.

12. A vacuum cleaner according to claim 11, wherein said second leg has a longitudinal axis that intersects an angle bisector of said angular distance.

13. A vacuum cleaner according to claim 1, wherein a diameter of said first leg is smaller than a height h of said passage.

14. A vacuum cleaner according to claim 1, wherein relative to said longitudinal central axis of said vacuum cleaner the center of gravity of said motor and the center of gravity of said suction fan are positioned diametrically opposite to said suction socket.

15. A vacuum cleaner according to claim 1, wherein, in an upright operating position of said vacuum cleaner, said first leg of said suction socket is spaced at a distance of substantially 80 cm above a floor surface.

16. A vacuum cleaner according to claim 1, wherein said receptacle is supported substantially vertically below said suction socket on a floor surface.

17. A vacuum cleaner according to claim 1, wherein said passage has a substantially parallelepipedal shape.

* * * * *